US007758134B2

(12) United States Patent
Huang

(10) Patent No.: US 7,758,134 B2
(45) Date of Patent: Jul. 20, 2010

(54) DRAWER FIXING APPARATUS

(75) Inventor: Kuo-Sheng Huang, Taipei County (TW)

(73) Assignee: Nan Juen International Co., Ltd., Taipei County (TW)

( * ) Notice: Subject to any disclaimer, the term of this patent is extended or adjusted under 35 U.S.C. 154(b) by 534 days.

(21) Appl. No.: 11/892,837

(22) Filed: Aug. 28, 2007

(65) Prior Publication Data

US 2009/0058241 A1 Mar. 5, 2009

(51) Int. Cl.
*A47B 88/00* (2006.01)

(52) U.S. Cl. ..... 312/334.47; 312/334.7

(58) Field of Classification Search ..... 312/333, 312/334.44, 334.47, 334.7; 384/21
See application file for complete search history.

(56) References Cited

U.S. PATENT DOCUMENTS 6,945,619 B1 * 9/2005 Chen et al. ..... 312/334.47
7,244,005 B1 * 7/2007 Lu ..... 312/333
7,374,261 B1 * 5/2008 Wang ..... 312/333
7,413,269 B2 * 8/2008 Chen et al. ..... 312/333
7,465,000 B2 * 12/2008 Huang ..... 312/333
7,588,299 B2 * 9/2009 Yang ..... 312/334.47
2008/0061663 A1 * 3/2008 Wu ..... 312/333
2008/0100190 A1 * 5/2008 Yang et al. ..... 312/333

* cited by examiner

*Primary Examiner*—Janet M Wilkens
*Assistant Examiner*—Dan Rohrhoff
(74) *Attorney, Agent, or Firm*—Muncy, Geissler, Olds & Lowe, PLLC

(57) ABSTRACT

A drawer fixing apparatus includes a bottom rail on a cabinet and having a movable latch member and at least one slide. The slide has a brake connected to a fixing member by a resilient member and an inner rail slidable on the slide and combined with a drawer. The inner rail includes a driven member having an embedding groove and a movable turning member pivotally connected to the driven member. As the inner rail moves with the drawer into the cabinet, the slide moves accordingly. The brake pushes the driven member to drive the turning member to rotate and press a latch member. When a user releases his/her hand, the resilient member pulls the brake backward slightly to resume the turning member to its original position, while the latch member falls naturally into the embedding groove of the driven member by gravitational force to achieve the positioning effect.

29 Claims, 7 Drawing Sheets

DRAWER FIXING APPARATUS

BACKGROUND OF THE INVENTION

1. Field of the Invention

The present invention relates to a drawer fixing apparatus, and more particularly to a way of fixing a slide module to an inner lateral side of a drawer to achieve an automatic positioning effect.

2. Description of the Related Art

In general, a drawer cabinet has several corresponding slide modules disposed on both lateral sides of the drawer cabinet, and each slide module has a bottom frame fixed at corresponding positions on both lateral sides of the drawer cabinet and embedded into a middle rail, and the middle rail is provided for extending the sliding length and embedded with an inner rail, and the inner rail is combined with a drawer, so that when the drawer is pulled out from the drawer cabinet, the middle rail will move outward accordingly and expose the drawer out from the drawer cabinet. On the other hand, when the drawer is pushed into the drawer cabinet, the middle rail and the inner rail will be overlapped on the bottom frame. However, when such devices are assembled, the bottom frame, the middle rail and the inner rail are embedded with each other, such that when the bottom frame is fixed to an inner lateral side of the drawer cabinet, the middle rail and the inner rail will be moved continuously during the back and forth movements of the drawer, which will cause troubles to the use of drawers. Since there is no positioning device, therefore other adjacent drawers may be moved together when one of the drawers is pulled and moved out, and thus the aforementioned application is obviously inconvenient.

SUMMARY OF THE INVENTION

In view of the shortcomings of the prior art, the inventor of the present invention based on years of experience in the related industry to conduct extensive researches and experiments, and finally developed a drawer fixing apparatus in accordance with the present invention to overcome the aforementioned shortcomings.

Therefore, it is a primary objective of the present invention to provide a drawer fixing apparatus, and the drawer apparatus has a bottom rail installed on a cabinet. The bottom rail has a movable latch member installed thereon and at least one slide. The slide has a brake connected to a fixing member by a resilient member and an inner rail that can be slid and moved on the slide. The inner rail is combined with the drawer, and the inner rail has a driven member, and the driven member has an embedding groove and a movable turning member, such that when the inner rail is moved together with the drawer towards the interior of the cabinet, the slide will move accordingly, and the fixing member will press onto the bottom rail, and the brake connected to the resilient member will drive the drawer to continue moving inward and push the driven member. As a result, a turning member on the driven member is pressed and rotated to turn the latch member. When the drawer reaches a specific position and a user releases his or her hand, the stretched resilient member will return the brake slightly backward to resume the original position of the turning member by the resilience, while the latch member will fall naturally into an embedding groove of a driven member by the gravitational force of the latch member, so as to achieve the positioning effect. On the other hand, the drawer will be pushed and moved towards the interior of the cabinet, such that the latch member will slide along the edge of the embedding groove and fall out from an opening of the embedding groove, and the drawer can be moved outward successfully. The invention can provide a convenient use and a positioning effect.

Another objective of the present invention is to provide a drawer fixing apparatus, whose embedding groove has a protruding rib and corresponding openings disposed separately on both lateral sides of the embedding groove, and the openings are corresponsive to the rib. Further, the latch member has a protruding embedding body disposed at an end with a shorter distance from the driven member, such that when the embedding body enters into the embedding groove from an opening, the embedding body will fall into another opening along the direction of the rib by its gravitational force and then out from the opening to separate the driven member, but the embedding body will remain on the turning member. The aforementioned movement continues as the drawer moves until the drawer is latched to the brake or separated from the brake.

To make it easier for our examiner to understand the objective of the invention, its structure, innovative features, and performance, we use preferred embodiments together with the attached drawings for the detailed description of the invention.

BRIEF DESCRIPTION OF THE DRAWINGS

FIG. 5-1 is a schematic view of movements of a drawer entering into a cabinet in accordance with the present invention;

FIG. 5-2 is a schematic view of movements of a brake turning a driven member in accordance with the present invention;

FIG. 5-3 is a schematic view of movements of a drawer entering and being positioned in a cabinet in accordance with the present invention;

FIG. 6-1 is a schematic view of movements of a drawer being pushed inward before being pulled out in accordance with the present invention;

FIG. 6-2 is a schematic view of movements of a drawer being pushed inward before being pulled out, and the latch member dropping down in accordance with the present invention;

FIG. 6-3 is another schematic view of movements of a drawer being pushed inward before being pulled out, and the latch member dropping down in accordance with the present invention;

FIG. 6-4 is a further schematic view of movements of a drawer being pushed inward before being pulled out, and the latch member dropping down in accordance with the present invention;

FIG. 6-5 is a schematic view of movements of latch member being separated from a brake in accordance with the present invention; and FIG. 6-6 is a schematic view of a drawer being pulled out in accordance with the present invention.

DETAILED DESCRIPTION OF THE PREFERRED EMBODIMENTS

In the related figures of preferred embodiments of a drawer fixing apparatus of the present invention, the same referring numerals are used for the same components in accordance with the present invention.

Figure 1:
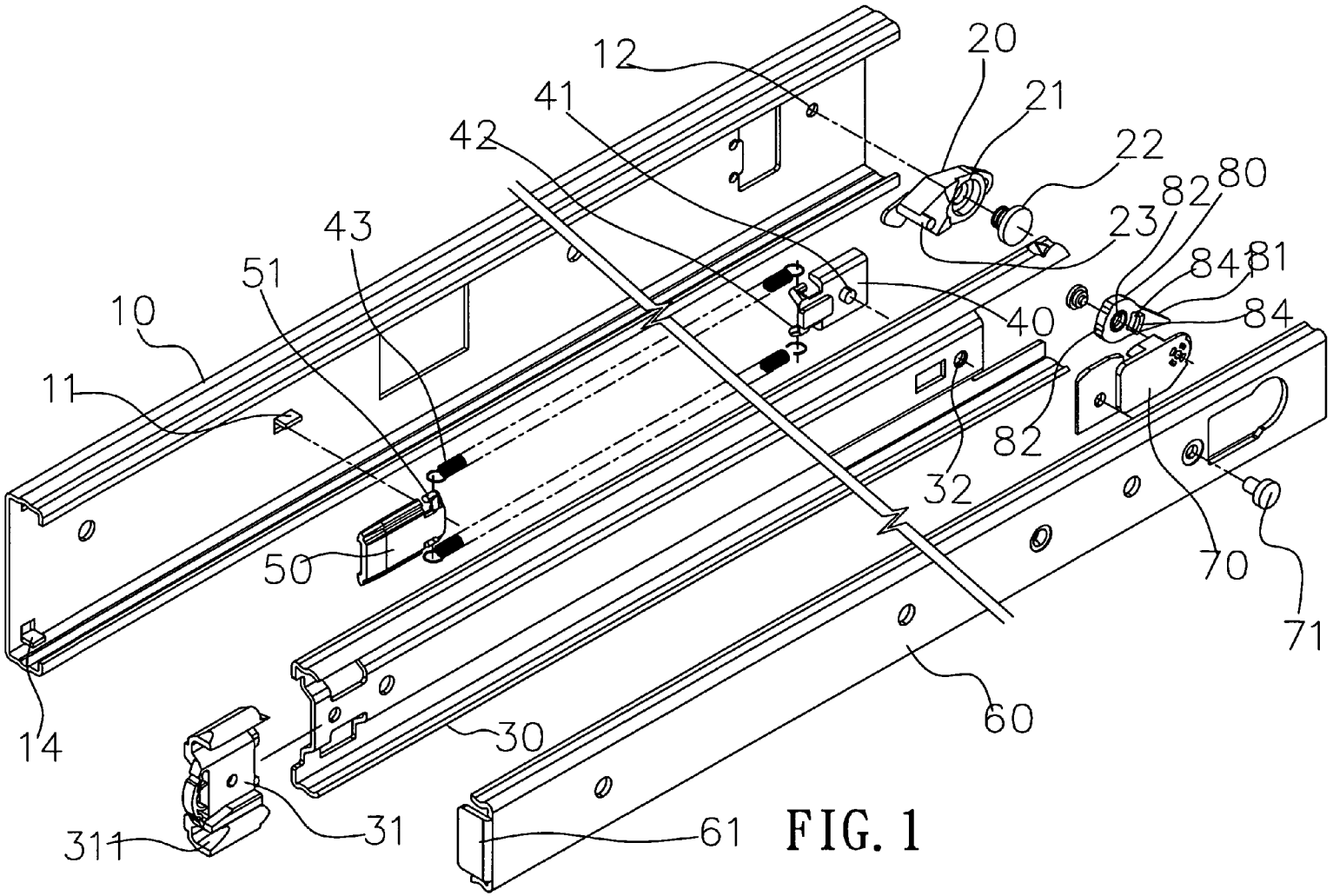
FIG. 1 is an exploded view of the present invention.
Figure 2:
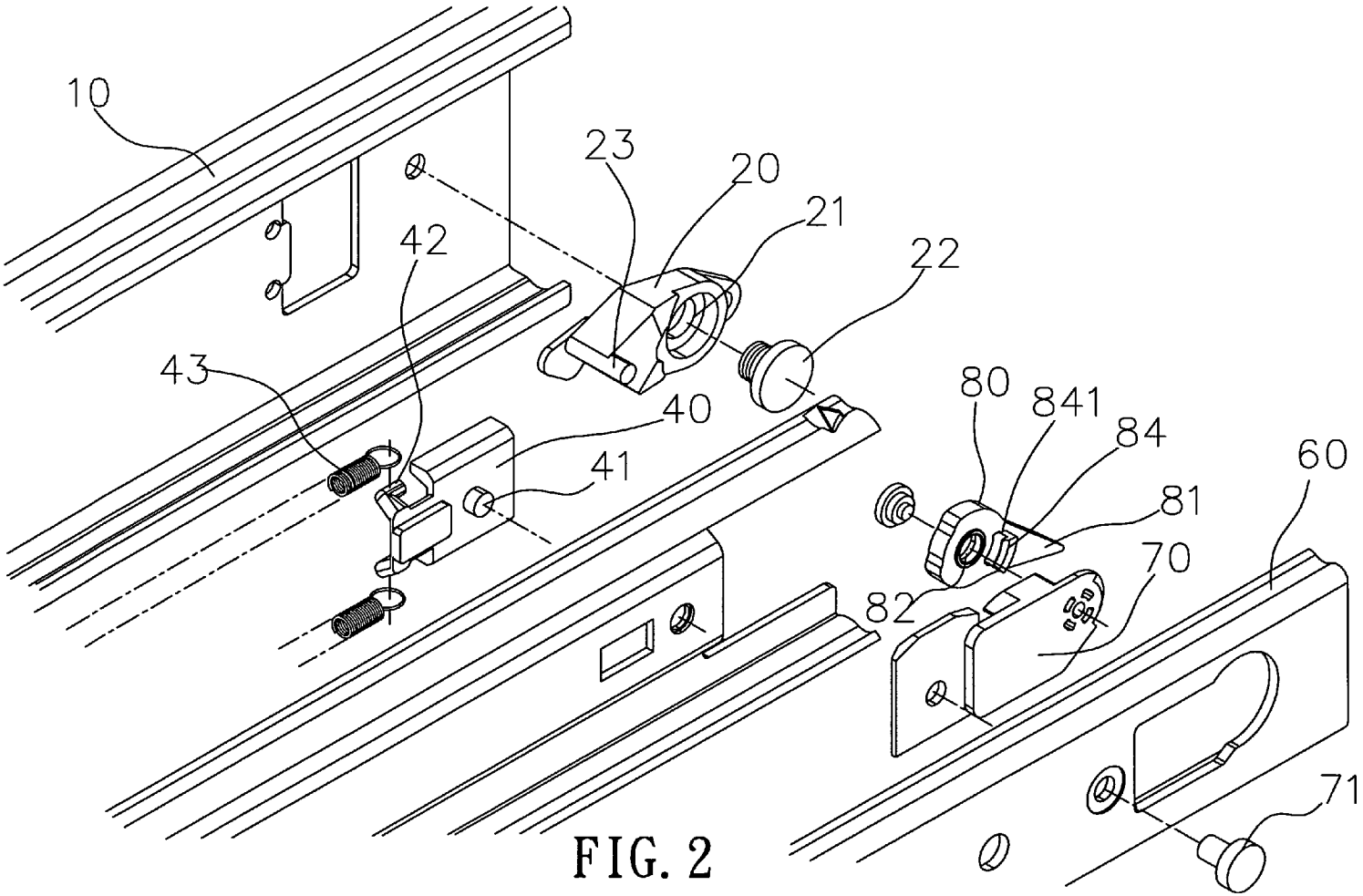
FIG. 2 is an exploded view of a part of modules of the present invention.
Figure 3:
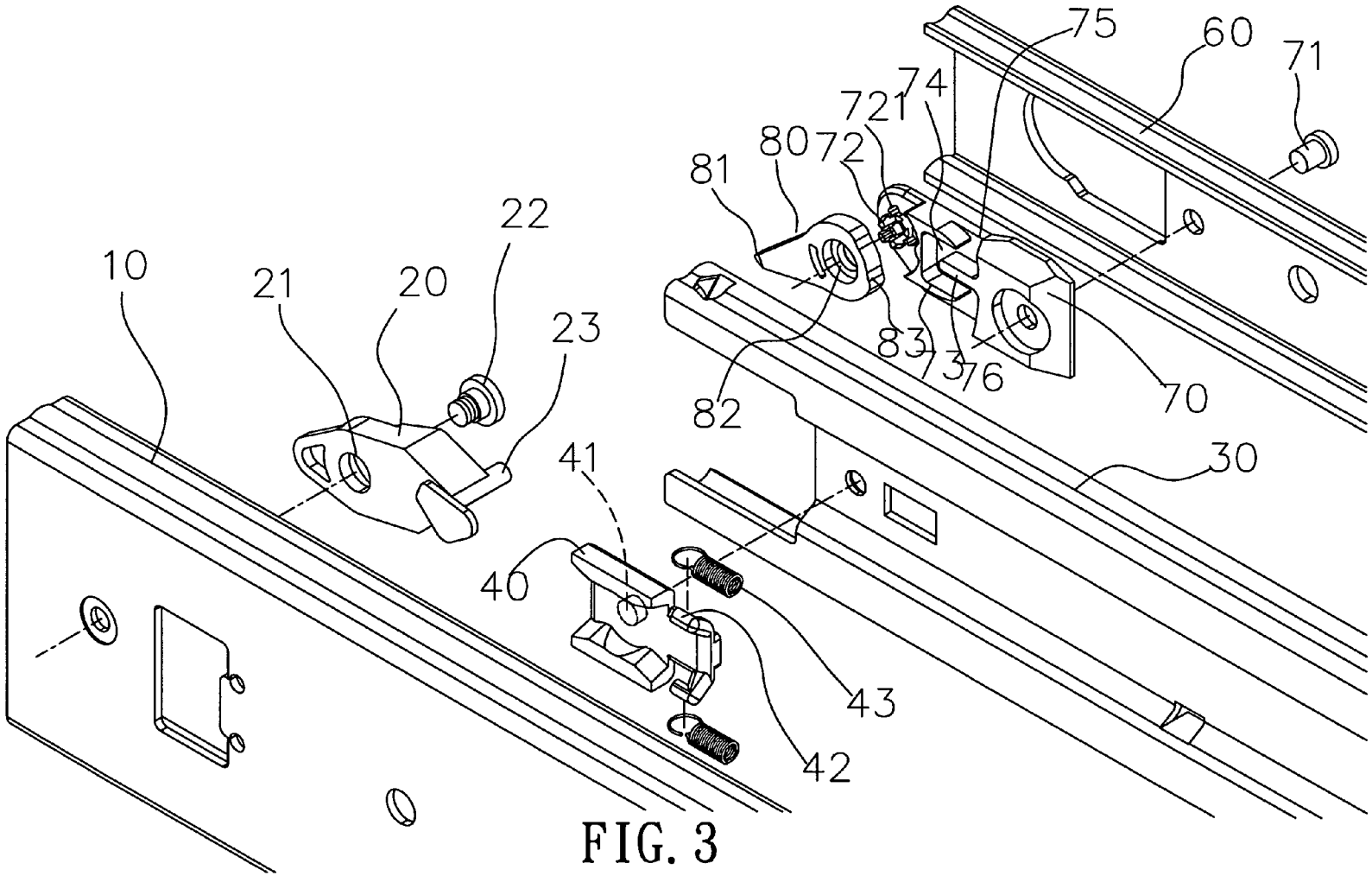
FIG. 3 is another exploded view of a part of modules of the present invention.
Figure 4:
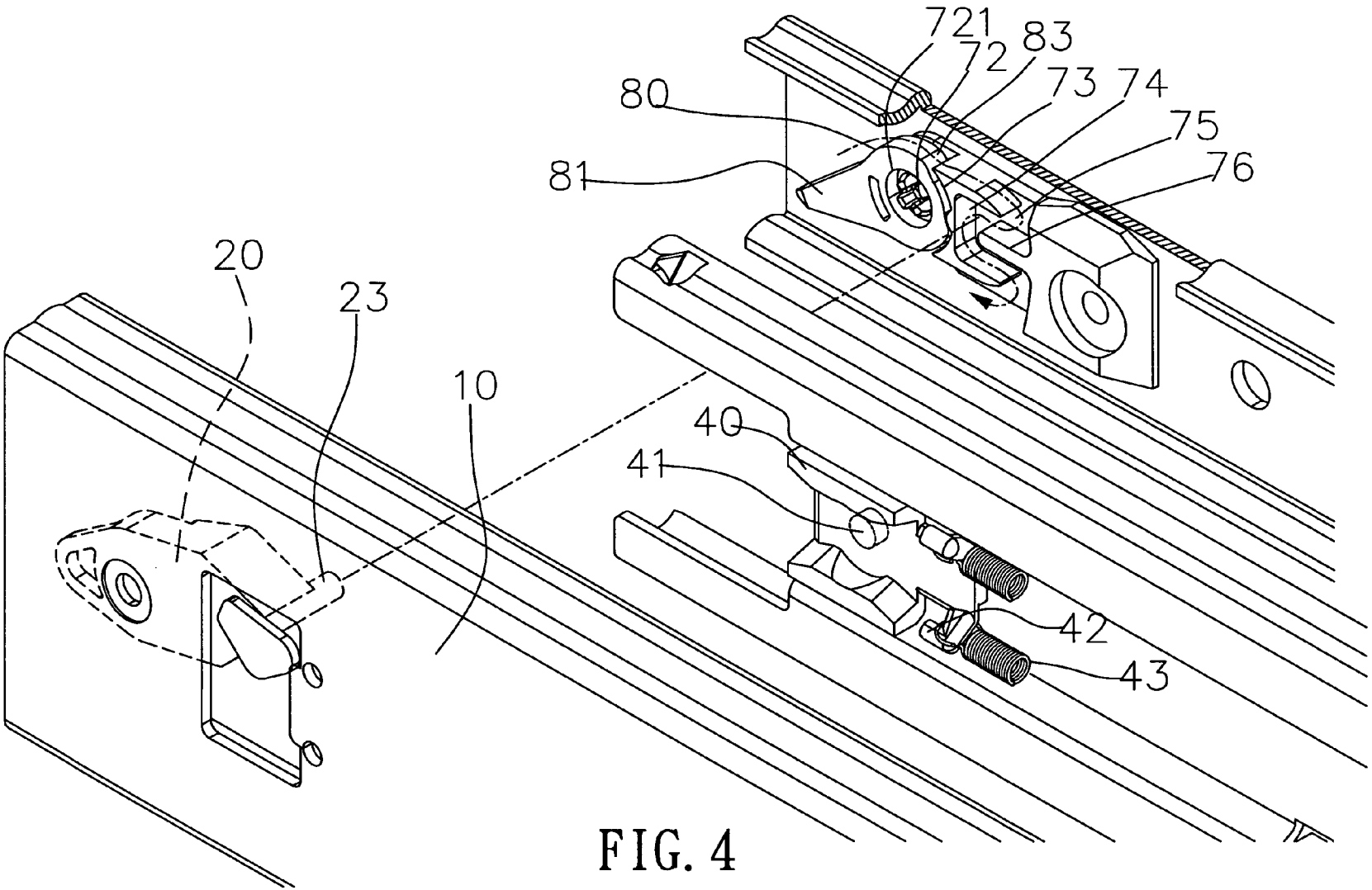
FIG. 4 is a schematic view of sliding a latch member of the present invention.

Referring to FIGS. 1 to 4 for a drawer fixing apparatus of the present invention, the drawer fixing apparatus comprises a bottom rail 10, which is a U-shape frame in this embodiment, and the bottom rail 10 can be fixed on both opposite walls (not shown in the figure) of a cabinet, and the bottom rail 10 has a protruding pillar 11 (which is a lump in this embodiment) formed by stamping onto the cabinet at an end proximate to an opening, and a latch member 20 pivotally coupled to another end, and the latch member 20 has a pivot hole 21, and a screw member 22 which is a screw rod secured into the pivot hole 21, and the screw member 22 is locked into a through hole 12 of the bottom rail 10, such that the latch member 20 and the bottom rail 10 are combined together, and the screw member 22 can be used as a center for rotation, and the latch member 20 has an embedding body 23 which is a cylinder protruded from an end away from the pivotal connection with the bottom rail 10.

The bottom rail 10 has at least one slide 30 embedded thereon, and there is one slide in this embodiment, and the slide 30 is a U-shape frame. The slide 30 has a positioning member 31, and the positioning member 31 has an open slot 311 disposed separately on both lateral sides of the positioning member 31, and corresponding to a protruding plate disposed at an end of the bottom rail 10 proximate to the opening, so that the slide 30 will not separate from the bottom rail 10 by means of the positioning effect of the positioning member 31 when it slides. However, such devices are prior arts and thus will not be described here. The slide 30 has a brake 40 (which is a frame in this embodiment) disposed on another end. The brake 40 has a protruding body 41 that can be fixed into a hole 32 of the slide 30, so that the brake 40 can be fixed onto the slide 30 facing a surface of the bottom rail 10, and the brake 40 has a corresponding fastener 42 fixed to an end away from the fixed end, and the fastener 42 (which is a protruding pillar in this embodiment) is latched with a resilient member 43 (which is a spring in this embodiment, but an ordinary person skilled in the art can substitute the spring with any other equivalent component), and another end of the resilient member 43 is latched onto a fixing member 50, and the fixing member 50 is disposed between the positioning member 31 and the protruding pillar 11 of the bottom rail 10, and the fixing member 50 also has a fastener 51 for latching the resilient member 43.

The slide 30 has an inner rail 60 (which is a U-shape frame in this embodiment) disposed thereon, and an end of the inner rail 60 has a stop member 61 pressed onto the positioning member 31 for driving the slide 30 to move, and another end of the inner rail 60 has a driven member 70 (which is a lump in this embodiment) disposed on another end facing a surface of the slide 30, and the driven member 70 is sheathed onto the inner rail 60 by a lock member 71 (which is a bolt in this embodiment) and fixed onto the inner rail 60, and situated at a position slightly higher than the same horizontal position of the inner rail 60 and the brake 40. Another end of the driven member 70 has a turning member 80 (which is a water drop shaped lump), and an end of the turning member 80 has an inwardly tapered turning portion 81, and another end of the turning member 80 has a circular hole 82 sheathed precisely onto a pivotal pillar 72 of the driven member 70, and an edge of the pivotal pillar 72 has more than one flanges 721 for increasing the friction between the circular hole 82 and the pivotal pillar 72 to adjust the rotating speed of the turning member 80, and the driven member 70 has a stop lump 73 protruded from a position facing the turning member 80 and corresponding to a positioning groove 83 disposed on a surface of a distal end of the turning member 80, such that when the turning member 80 rotates, the turning member 80 is fixed to its position by the positioning groove 83 and the stop lump 73, and the turning member 80 has a guide member 84 disposed at a position in contact with an edge of the driven member 70, and the guide member 84 has a guide slot 841 embedded precisely into a position away from the driven member 70 and fixed onto an edge of the inner rail 60, so that the turning member 80 can rotate along a distal edge of the driven member 70.

The driven member 70 has an embedding groove 74 disposed proximate to the turning member 80 and facing the slide 30, and both lateral sides of the embedding groove 74 have corresponding openings 75, and the embedding groove 74 has a rib 76 extended towards the opening 75.

Figures 1, 5:
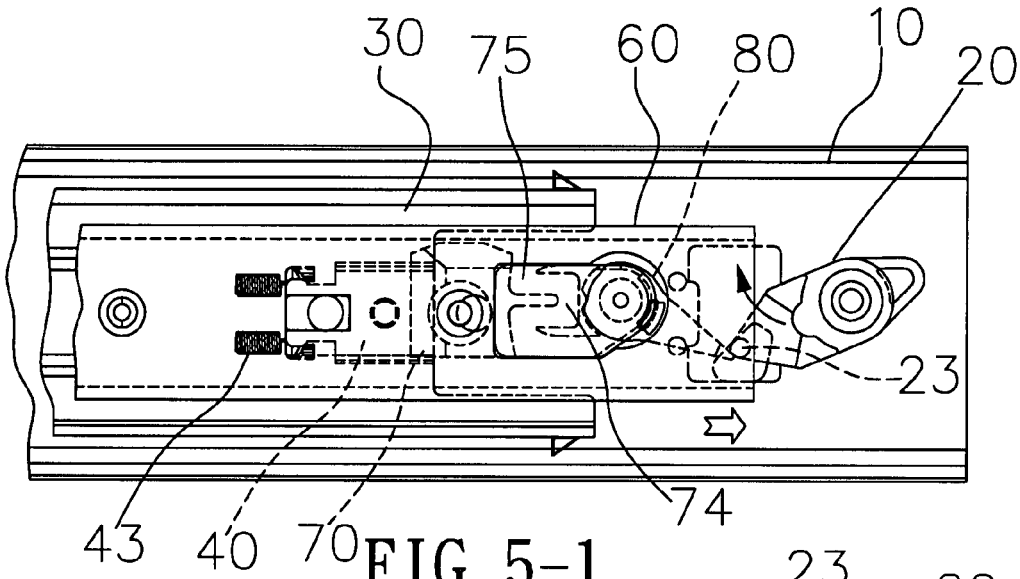
Figures 2, 5:
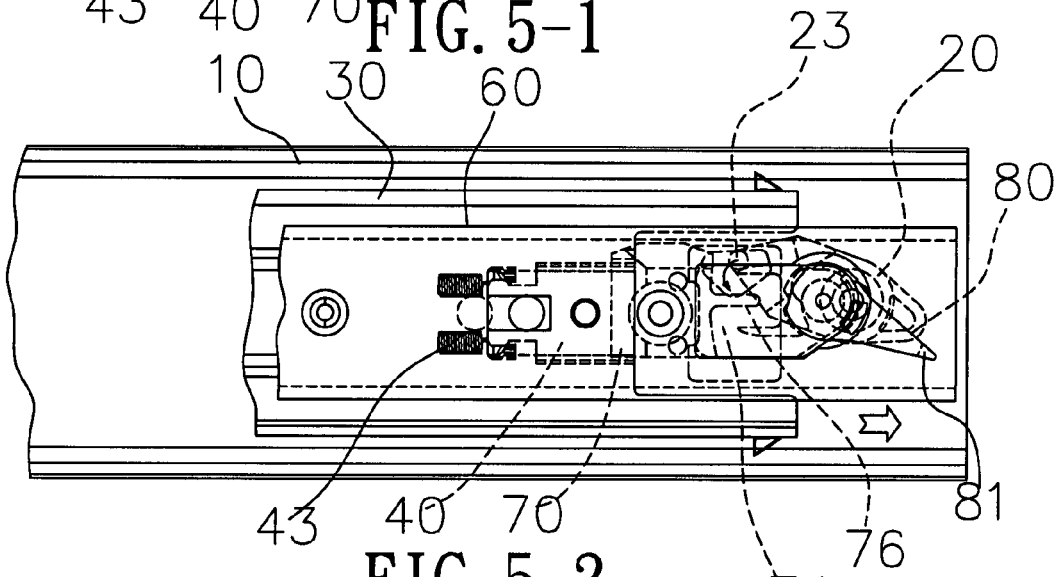
Figures 3, 5:
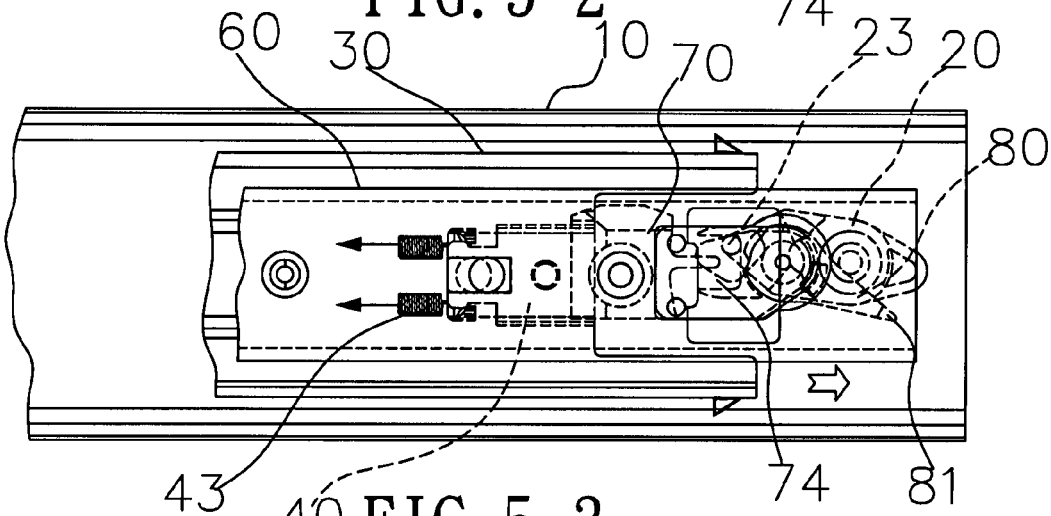

Referring to FIGS. 5-1, 5-2 and 5-3, the drawer is pushed into the cabinet first, so that the inner rail 60 will move accordingly, and the slide 60 will block the slide 30 by the stop member 61, such that the slide 30 moves inward. When the slide 30 is moving, the fixing member 50 will touch the protruding pillar 11 of the bottom rail 10 and then will remain at a fixed position, but the slide 30 will continue moving inward together with the inner rail 60, and the resilient member 43 will be moved together with the brake 40 and stretched and deformed, such that the brake 40 will press onto the driven member 70, and the driven member 70 gradually approaches the latch member 20 to drive the driven member 70 to press the turning member 80, and the turning member 80 moves from a fixed point to another fixed point to change the angle of the latch member 20, and the turning member 80 is turned by the turning portion 81 to approach an opening 75 of the embedding groove 74 of the driven member 70, while the turning member 80 is pressed as the driven member 70 moves and gradually separated from the latch member 20, so that the embedding body 23 of the latch member 20 falls naturally into the embedding groove 74 by its gravitational force, and the brake 40 moves outward automatically by the resilience of the resilient member 43 to slightly move the driven member 70 accordingly, and the embedding body 23 is latched and fixed into the embedding groove 74 to achieve the automatic positioning effect of the drawer.

Figures 1, 6:
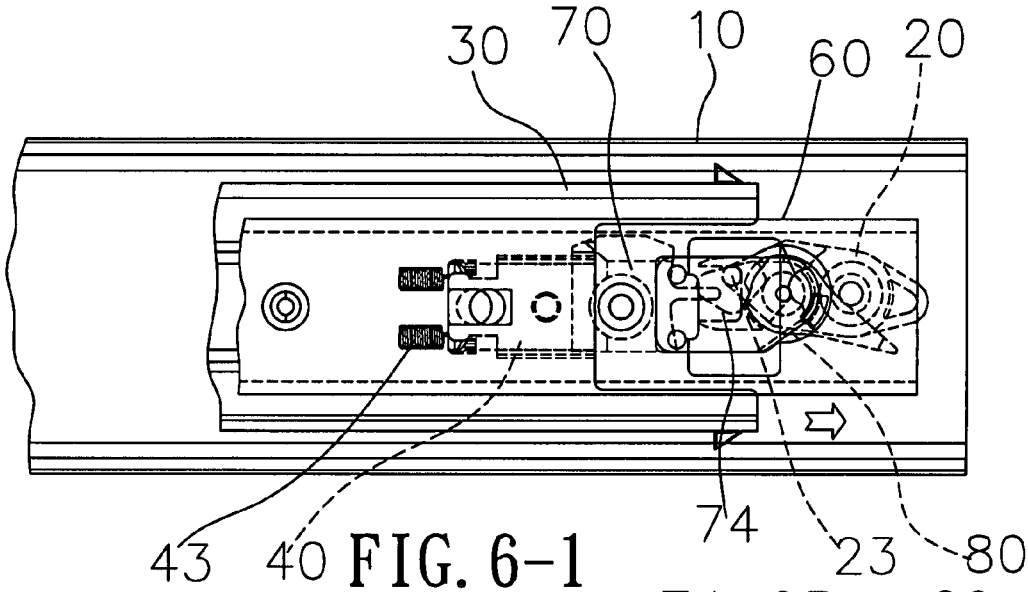
Figures 2, 6:
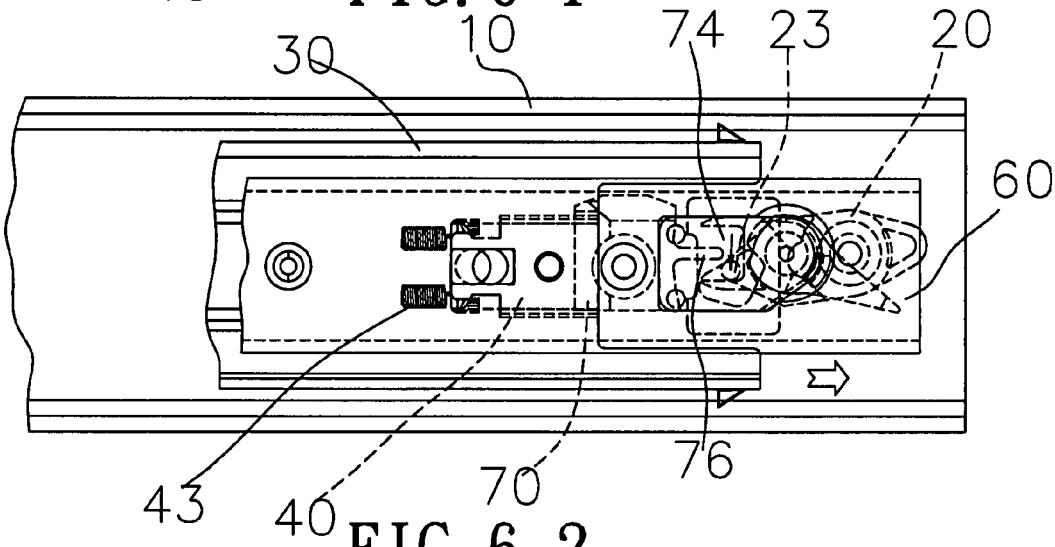
Figures 3, 6:
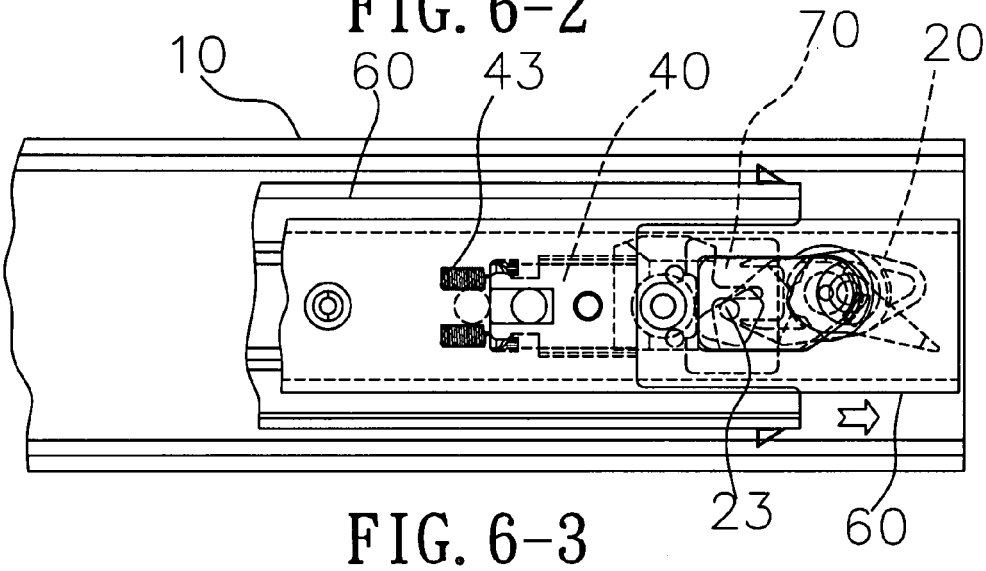
Figures 4, 6:
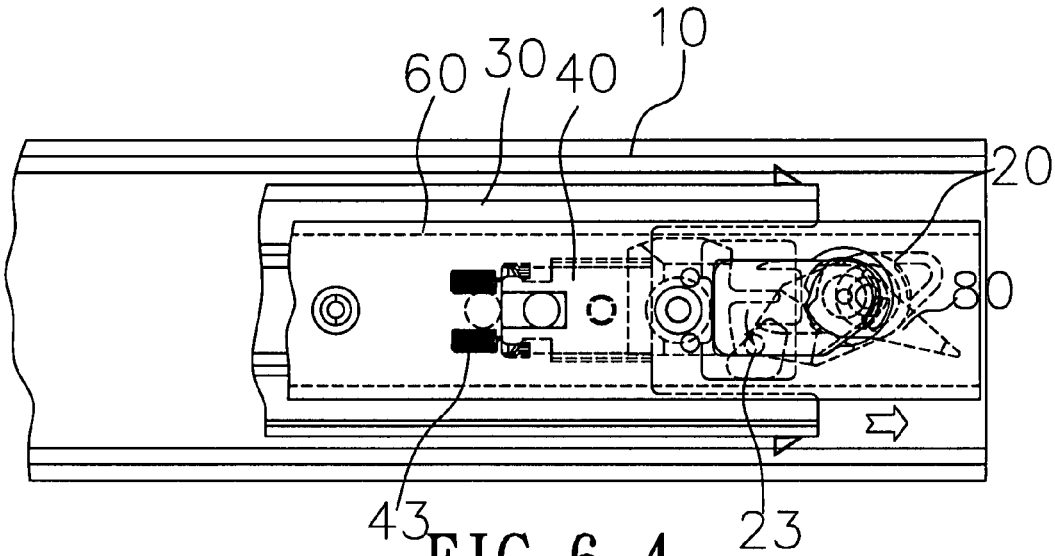
Figures 5, 6:
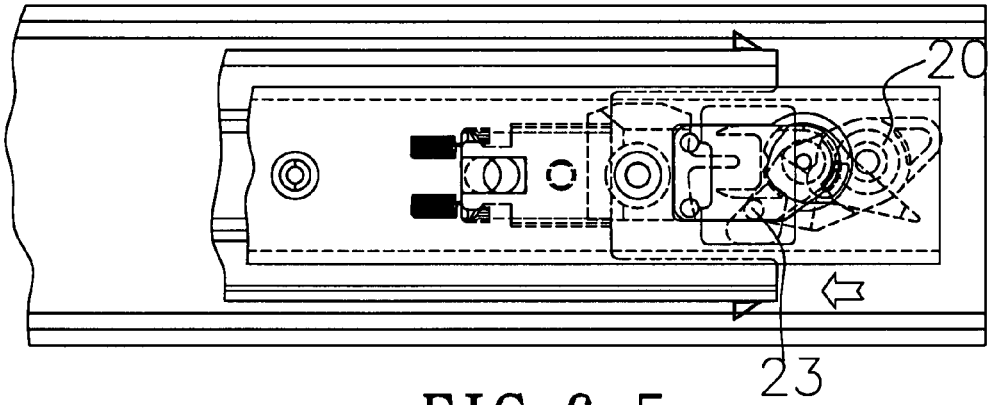
Figure 6:
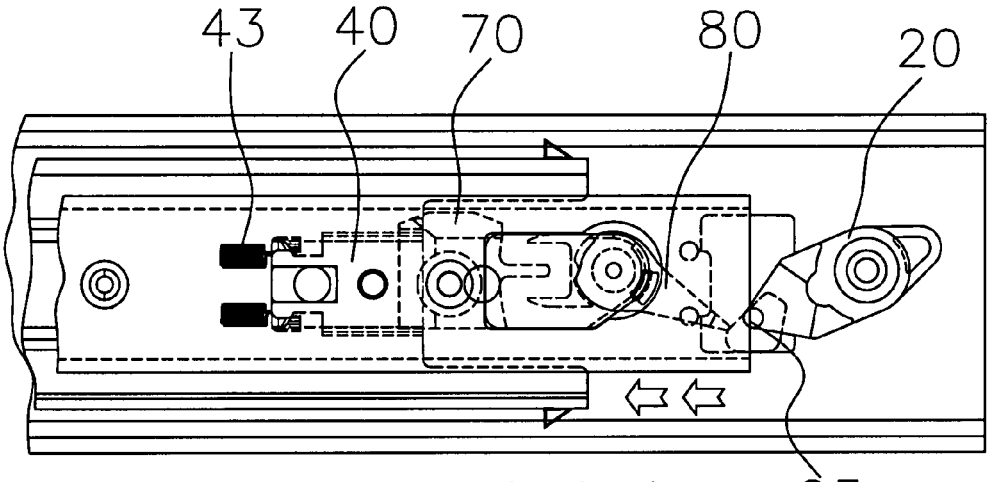

Referring to FIGS. 6-1, 6-2, 6-3, 6-4, 6-5 and 6-6, when the drawer is pulled out from the cabinet, the drawer is compressed inward to move the embedding body 23 in the embedding groove 74 along the rib 76 towards another opening 75, until the embedding body 23 falls out from another opening 75, and then the resilience of the resilient member 43 pulls the drawer out.

In summation of the description above, the shape and structure of the drawer fixing apparatus of the present invention comply with the patent requirements and thus the invention is duly filed for patent application.

While the invention has been described by way of examples and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A drawer fixing apparatus, comprising:

a bottom rail, fixed onto an object, and having a latch member disposed at an end of the bottom rail;

at least one slide, embedded into the bottom rail and moved back and forth on the bottom rail, and having a brake disposed proximate to a latch member, and the brake being connected by a resilient member for resuming the original position of the slide by the resilience of a resilient member during a push-and-pull process;

an inner rail, fixed to a drawer that can be moved on the object, and having a driven member, and the driven member having an embedding groove; and a turning member, pivotally coupled to the driven member, and rotated in a predetermined angle;

thereby, if the inner rail is moved, the slide will move accordingly, and the brake will move accordingly to press onto the driven member and push the driven member, so that the turning member on the driven member is compressed to rotate, and turn the latch member, and the stretched resilient member will pull the brake slightly backward to resume the turning member to its original position by the resilience of the resilience member, and the latch member will fall naturally into an embedding groove of the driven member by gravitational force to achieve a positioning effect; and on the other hand, the drawer is pushed slightly towards the interior of the object, such that the latch member will slide along the edge of the embedding groove and fall out from the embedding groove, so as to move the drawer outward successfully.

2. The drawer fixing apparatus of claim 1, wherein the bottom rail, the slide and the inner rail are U-shape frames.

3. The drawer fixing apparatus of claim 1, wherein the resilient member has an end fixed onto the brake and another end fixed onto the fixing member, and the fixing member is limited at a distal edge of the slide and away from the brake and on a protruding pillar of the bottom rail.

4. The drawer fixing apparatus of claim 1, wherein the resilient member is a spring.

5. The drawer fixing apparatus of claim 1, wherein the latch member is pivotally coupled onto the bottom rail by a screw member.

6. The drawer fixing apparatus of claim 5, wherein the screw member is a screw rod.

7. The drawer fixing apparatus of claim 1, wherein the latch member has an embedding body protruded from an end away from the bottom rail.

8. The drawer fixing apparatus of claim 7, wherein the embedding body is a cylinder.

9. The drawer fixing apparatus of claim 1, wherein the brake has a protruding body fixed into a hole of the slide for fixing the brake onto a surface of the slide facing the bottom rail.

10. The drawer fixing apparatus of claim 1, wherein the driven member is sheathed onto a lock member of the inner rail and fixed onto the inner rail.

11. The drawer fixing apparatus of claim 10, wherein the lock member is a bolt.

12. The drawer fixing apparatus of claim 1, wherein the embedding groove of the driven member has a protruding rib, and corresponding openings disposed separately on both lateral sides of the embedding groove and corresponding to the rib, such that when the embedding body of the latch member enters into the embedding groove of an opening, the embedding body falls into another opening along the direction of the rib by gravitational force, and out from the opening to separate the driven member.

13. The drawer fixing apparatus of claim 1, wherein the turning member has an inwardly tapered turning portion disposed on an end of the turning member and a circular hole disposed on another end of the turning member and precisely sheathed onto a pivotal pillar of the driven member, and the pivotal pillar has more than one flange disposed at an edge of the pivotal pillar for increasing the friction between the circular hole and the pivotal pillar.

14. The drawer fixing apparatus of claim 1, wherein the driven member has a stop lump protruded from a position facing the turning member and precisely corresponding to a positioning groove on a distal surface of the turning member, such that when the turning member is rotated, the driven member is fixed into a position by the positioning groove and the stop lump.

15. The drawer fixing apparatus of claim 1, wherein the turning member has a guide member disposed at a position in contact with an edge of the driven member, and the guide member has a guide slot precisely embedded into a distal edge away from the driven member and fixed to the inner rail, such that the turning member can rotate along the distal edge of the driven member.

16. A drawer fixing apparatus, comprising:

a bottom rail, fixed onto an object, and having a latch member disposed at an end of the bottom rail;

at least one slide, embedded into the bottom rail and moved back and forth on the bottom rail, and having a brake disposed proximate to a latch member;

a fixing member, fixed to an end of the brake and away from the slide, connected to the brake by a resilient member, and limited onto a protruding pillar of the bottom rail, and the protruding pillar being fixed onto the bottom rail and away from a distal edge of the latch member;

an inner rail, fixed to a drawer that can be moved on the object, and having a driven member, and the driven member having an embedding groove; and a turning member, pivotally coupled to the driven member, and rotated in a predetermined angle;

thereby, if the inner rail is moved, the slide will move accordingly, and the brake will move accordingly to press onto the driven member and push the driven member, so that the turning member on the driven member is compressed to rotate and turn the latch member, and the fixing member will be latched onto protruding pillar, and the stretched resilient member will pull the brake slightly backward to resume the turning member to its original position by the resilience of the resilience member, and the latch member will fall naturally into an embedding groove of the driven member by gravitational force to achieve a positioning effect; and on the other hand, the drawer is pushed slightly towards the interior of the object, such that the latch member will slide along the edge of the embedding groove and fall out from the embedding groove, so as to move the drawer outward successfully.

17. The drawer fixing apparatus of claim 16, wherein the bottom rail, the slide and the inner rail are U-shape frames.

18. The drawer fixing apparatus of claim 16, wherein the resilient member is a spring.

19. The drawer fixing apparatus of claim 16, wherein the latch member is pivotally coupled onto the bottom rail by a screw member.

20. The drawer fixing apparatus of claim 19, wherein the screw member is a screw rod.

21. The drawer fixing apparatus of claim 16, wherein the latch member has an embedding body protruded from an end away from the bottom rail.

22. The drawer fixing apparatus of claim 21, wherein the embedding body is a cylinder.

23. The drawer fixing apparatus of claim 16, wherein the brake has a protruding body fixed into a hole of the slide for fixing the brake onto a surface of the slide facing the bottom rail.

24. The drawer fixing apparatus of claim 16, wherein the driven member is sheathed onto a lock member of the inner rail and fixed onto the inner rail.

25. The drawer fixing apparatus of claim 24, wherein the lock member is a bolt.

26. The drawer fixing apparatus of claim 16, wherein the embedding groove of the driven member has a protruding rib, and corresponding openings disposed separately on both lateral sides of the embedding groove and corresponding to the rib, such that when the embedding body of the latch member enters into the embedding groove of an opening, the embedding body falls into another opening along the direction of the rib by gravitational force, and out from the opening to separate the driven member.

27. The drawer fixing apparatus of claim 16, wherein the turning member has an inwardly tapered turning portion disposed on an end of the turning member and a circular hole disposed on another end of the turning member and precisely sheathed onto a pivotal pillar of the driven member, and the pivotal pillar has more than one flange disposed at an edge of the pivotal pillar for increasing the friction between the circular hole and the pivotal pillar.

28. The drawer fixing apparatus of claim 16, wherein the driven member has a stop lump protruded from a position facing the turning member and precisely corresponding to a positioning groove on a distal surface of the turning member, such that when the turning member is rotated, the driven member is fixed into a position by the positioning groove and the stop lump.

29. The drawer fixing apparatus of claim 16, wherein the turning member has a guide member disposed at a position in contact with an edge of the driven member, and the guide member has a guide slot precisely embedded into a distal edge away from the driven member and fixed to the inner rail, such that the turning member can rotate along the distal edge of the driven member.

* * * * *